US009081350B2

(12) United States Patent
Terao

(10) Patent No.: US 9,081,350 B2
(45) Date of Patent: Jul. 14, 2015

(54) IMAGE DECOLORIZING DEVICE WITH MOVABLE CONTACT PARTS, AND RELATED METHOD

(71) Applicant: Toshiba Tec Kabushiki Kaisha, Tokyo (JP)

(72) Inventor: Yasunobu Terao, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 46 days.

(21) Appl. No.: 13/840,000

(22) Filed: Mar. 15, 2013

(65) Prior Publication Data

US 2013/0243504 A1 Sep. 19, 2013

Related U.S. Application Data

(60) Provisional application No. 61/612,229, filed on Mar. 16, 2012.

(51) Int. Cl.

| | |
|---|---|
| ***G03G 15/20*** | (2006.01) |
| ***G03G 15/00*** | (2006.01) |
| ***G03G 21/00*** | (2006.01) |

(52) U.S. Cl.

CPC ..... *G03G 15/6582* (2013.01); *G03G 21/00* (2013.01)

(58) Field of Classification Search

CPC G03G 21/00; G03G 15/6582; G03G 15/5062
USPC ..... 399/43, 329, 341
See application file for complete search history.

(56) References Cited

U.S. PATENT DOCUMENTS

| | | | | |
|---|---|---|---|---|
| 7,162,168 | B2 * | 1/2007 | Kunimori | 399/45 |
| 2010/0086324 | A1 * | 4/2010 | Smith | 399/67 |
| 2010/0215381 | A1 * | 8/2010 | Li et al. | 399/9 |
| 2012/0308255 | A1 * | 12/2012 | Sakai | 399/90 |
| 2012/0321335 | A1 * | 12/2012 | Fujiwara | 399/69 |
| 2013/0002782 | A1 * | 1/2013 | Kawaguchi et al. | 347/179 |

FOREIGN PATENT DOCUMENTS

| | | |
|---|---|---|
| JP | 06-332332 | 12/1994 |
| JP | 08-036319 | 2/1996 |
| JP | 2002-091215 | 3/2002 |
| JP | 2005-258383 | 9/2005 |

OTHER PUBLICATIONS

U.S. Appl. No. 13/484,195, Takahiro Kawaguchi et al., filed May 30, 2012, 50 pages.

* cited by examiner

*Primary Examiner* — Francis Gray
(74) *Attorney, Agent, or Firm* — Patterson & Sheridan, LLP

(57) ABSTRACT

An image decolorizing device according to an embodiment comprises a heating unit configured to generate heat and apply the heat to a recording medium, and a pressure roller that forms a nip with the heating unit. The image decolorizing device further comprises a first contact part positioned in contact with the heating unit at a first position upstream of the nip in a rotation direction of the heating unit and fixed in the rotating direction, and a second contact part positioned in contact with the heating unit at a second position upstream of the nip in the rotation direction and fixed in the rotating direction. In the image decolorizing device, the first and second contact parts are configured to apply a voltage to the heating unit causing the heating unit to generate heat over a heating area between the first and second positions.

20 Claims, 6 Drawing Sheets

IMAGE DECOLORIZING DEVICE WITH MOVABLE CONTACT PARTS, AND RELATED METHOD

CROSS-REFERENCE TO RELATED APPLICATION

This application is based upon and claims the benefit of priority from U.S. Provisional Patent Application No. 61/612,229, filed Mar. 16, 2012; the entire contents of which are incorporated herein by reference.

FIELD

Embodiments described herein relate to a decolorizing device that decolorizes an image of a paper on which the image has been formed by an image forming device.

BACKGROUND

There has been a technique that decolorizes colors of an image by applying heat to a sheet on which the image has been formed with toners whose colors are erased at a prescribed temperature or higher. As a device that is used in this image decolorization, a decolorizing device of a roll heating type, which erases an image on a sheet by passing the sheet between a roller pair including a heating roller and a pressure roller in pressure contact with the heating roller, has been generally employed.

In heating of a sheet surface in the roll heating technique, a lamp as a heat source is included in the heating roller formed of a metal pipe. The pipe surface is warmed from the inner surface of the heating roller by radiant heat that is generated from the lamp.

However, in the configuration, since the entire pipe is warmed, a long heating time is required until the heating roller surface reaches a set temperature. In addition, as another problem, since the entire pipe is uniformly heated, even if there is an area that may not be decolorized, the same energy is applied, causing unnecessary power consumption.

DESCRIPTION OF THE DRAWINGS

The accompanying drawings, which are incorporated in and constitute a part of this specification, illustrate an embodiment of the disclosure and together with the description, serve to explain the principles of the disclosure.

DETAILED DESCRIPTION

In general, embodiments are illustrated with reference to the accompanying drawing.

An image decolorizing device according to an embodiment for decolorizing a toner image, which has been formed on a recording medium and can be decolorized by heating, includes a cylindrical resistance heating element that can generate heat. A pressure roller forms a nip by pressure-contacting the cylindrical heating element and passes the recording medium through the nip. A first contact part contacts the cylindrical heating element at an upstream position of the nip and is fixed in the rotating direction of the cylindrical heating element. A second contact part contacts the cylindrical heating element at an upstream position of the nip and is fixed in the rotating direction of the cylindrical heating element. A voltage is applied to the first contact part and the second contact part to cause the cylindrical heating element to generate heat.

Next, this embodiment will be explained with reference to the drawings. The same reference numbers may be used in the following explanation, indicating similar configurations and functions.

Figure 1:
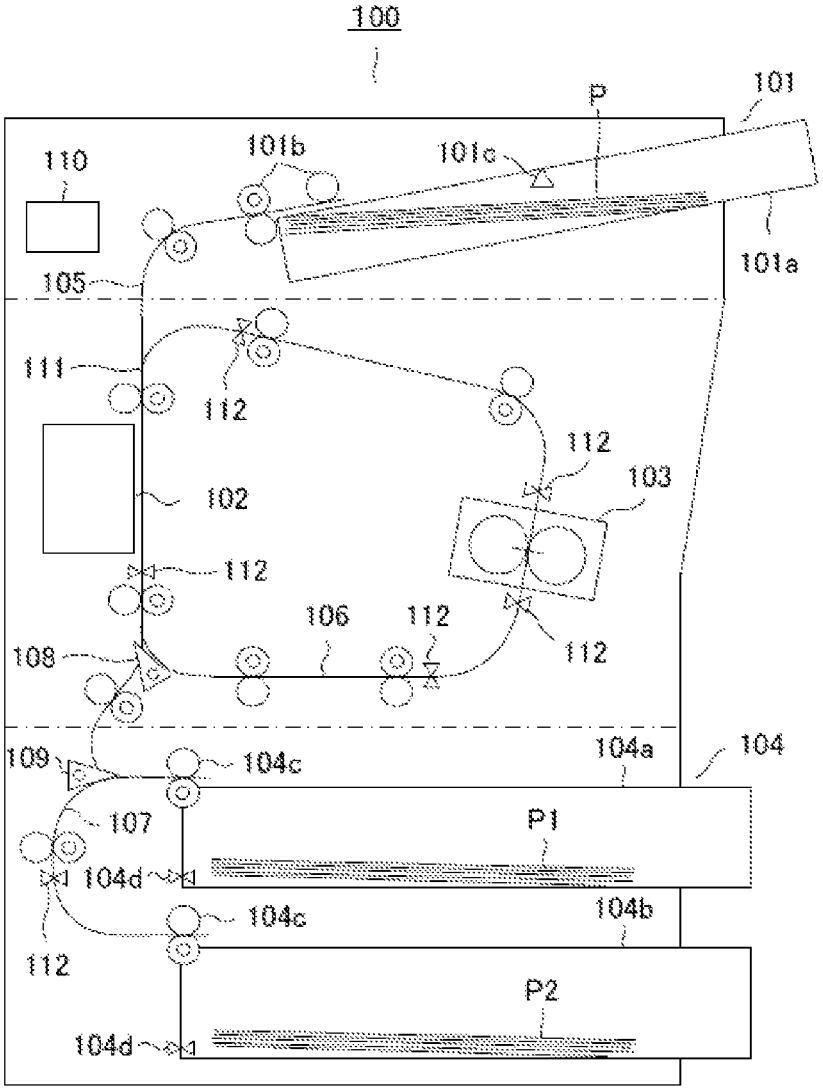
FIG. 1 is a schematic diagram showing the image decolorizing device according to an embodiment.

FIG. 1 is an outlined diagram showing the entire configuration of the image decolorizing device according to an embodiment. An image decolorizing device 100 applies a decolorization treatment for erasing colors of images to sheets P, which are recording media on which the images have been formed with an erasable colorant such as erasable toners or erasable inks. The image decolorizing device 100 includes a paper feed unit 101, a reading unit 102, a decolorization unit 103, a paper discharge part 104, a first conveying path 105, a second conveying path 106, a third conveying path 107, a first branch member 108, a second branch member 109, and a control unit 110.

The paper feed unit 101 includes a paper feed tray 101*a* and a paper feed member 101*b*. The paper feed tray 101*a* holds the sheets P for reutilization. The paper feed tray 112 holds sheets with various sizes such as A4, A3, and B5. The sheets P, which are loaded into the paper feed tray 101*a*, for example, are sheets on which images have been formed of a recording material that is decolorized by heating at a prescribed temperature or higher.

The paper feed member 101*b* includes a pickup roller, a sheet feed roller, and a separation roller. The separation roller is disposed opposite to the sheet feed roller, and feeds the sheets P from the paper feed tray 101*a* one sheet at a time to the first conveying path 105 in the image decolorizing device 100. In addition, the paper feed tray 101*a* includes a detection sensor 101*c* for detecting the presence of sheets on the paper feed tray 101*a*. The detection sensor 101*c*, for example, may be a microsensor or microactuator.

The reading unit 102 is disposed along the first conveying path 105, downstream in the sheet conveying direction with respect to the paper feed tray 101*a*. The reading unit 102, for example, includes a reading unit such as CCD (Charge Coupled Device) scanner or CMOS sensor. The reading unit 102 is disposed along the first conveying path 105. The reading unit 102 reads images on surfaces, on which the toner images have been formed, of the sheets P that have been conveyed. The images read by the reading unit 102 are stored in a memory, which will be described later, in the control unit 110. For example, before an decolorization treatment, the reading unit 102 electronically processes the images on the sheets and stores the images in the memory. Thus, the image data is available when data of decolorized images is required later. In addition, based on the images read by the reading unit 102, the control unit 110 decides whether or not the sheets can be decolorized and/or whether or not the sheets are reusable.

At a downstream of the reading unit 102, the first branch member 108 acts as a switching part. The first branch member 108 switches the conveying direction of the sheets that are conveyed. The first branch member 108 conveys the sheets, which are conveyed through the first conveying path 105, to either the paper discharge part 104 or the second conveying path 106. The second conveying path 106 is branched from the first conveying path 105 at a branch point where the first branch member 108 is disposed. The second conveying path 106 branched from the branch point conveys the sheets P to the decolorization unit 103.

The decolorization unit 103 decolorizes the images on the sheets P that are conveyed. The decolorization unit 103 heats the sheets P up to a prescribed decolorization temperature as the decolorization part contacts the sheets P. In this manner, the images formed on the sheets are decolorized. The decolorization unit 103 includes a cylindrical heating element 103*a* and a pressure roller 103*b*. The cylindrical heating element 103*a* and the pressure roller 103*b* are arranged opposite of each other along the second conveying path 106. The sheets P are sandwiched by the heating element 103*a* and the pressure roller 103*b* and conveyed, thus decolorizing the toner images on the sheets P.

The paper discharge part 104 includes a first paper discharge tray 104*a*, a second paper discharge tray 104*b*, and paper discharge members 104*c*. The first paper discharge tray 104*a* and the second paper discharge tray 104*b* are vertically arranged. The first paper discharge tray 104*a* and the second paper discharge tray 104*b* are provided with loading sheet detection sensors 104*d*. The loading sheet detection sensors 104*d* sense when the number of loading sheet reaches an allowable number of loading sheet of the first paper discharge tray 104*a* and the second paper discharge tray 104*b*. When the loading sheet detection sensors 104*d* sense that the number of loading sheet has reached the allowable number of loading sheets for the respective paper discharge tray 104*a* or 104*b*, a signal is sent to the control unit 110. The loading sheet detection sensors 104*d*, for example, may be microsensors or microactuators.

The first paper discharge tray 104*a*, for example, is loaded with reusable sheets P1 whose images on the sheets P have been decolorized. The second paper discharge tray 104*b* is loaded with sheets P2 that are determined to be non-reusable sheets. The paper discharge members 104*c* discharge the sheets P1 and P2 to the first paper tray 104*a* and the second paper discharge tray 104*b*, respectively. The first paper discharge tray 104*a* and the second paper discharge ray 104*b* can be changed with respect to the kinds of sheets that are to be received. The kinds of sheets that are loaded into each paper discharge tray, that is, sheet conveyance destinations, for example, may be set and/or changed from the operation unit 110. Based on the setting, the second branch member 109 switches the conveying path and guides the conveyed sheets to the first paper discharge tray 104*a* or the third conveying path 107.

The first conveying path 105 forms a conveying path from the paper feed tray 101*a* toward the first paper discharge tray 104*a*. The first conveying path 105 conveys the fed sheets to either the reading unit 102 or the first paper discharge trays 104*a*. The first conveying path 105 has the second branch member 109 at a downstream of the first branch member 108. The second branch member 109 guides the sheets conveyed from the first branch member 108 to the first paper discharge tray 104*a* or the third conveying path 107. The third conveying path 107 conveys the sheets P2 to the second paper discharge tray 104*b*.

The second conveying path 106 is joined with the first conveying path 105 at a confluence point 111 upstream in the sheet conveying direction from the reading unit 102. In other words, the second conveying path 106 is joined with the first conveying path 105 at the confluence point 111 between the paper feed unit 101 and the reading unit 102. Therefore, the second conveying path 106 can re-convey the sheets P conveyed from the reading unit 102 to the reading unit 102 again, after the sheets P have been erased in the decolorization unit 103. In other words, the image decolorizing device 100 can convey the sheets P, which have been fed from the paper feed par 101, to the reading unit 102, the decolorization unit 103, and the reading unit 102 in order, by controlling the first branch member 108.

The control unit 110 has a processor including a CPU (Central Processing Unit) or MPU (Micro Processing Unit) and a memory. The control unit 110 controls the processing that is carried out in the image decolorizing device 100 of the paper feed unit 101, the reading unit 102, the decolorization unit 103, and the paper discharge part 104. The memory is, for example, a semiconductor memory and has a ROM (Read Only Memory) for storing various kinds of control programs and a RAM (Random Access Memory) for providing the processor a temporary work area. For example, the ROM stores printing rate of sheets as a threshold for reusability, density threshold for deciding whether or not images have been decolorized, and the like. The RAM may temporarily store the images read by the reading unit 102.

The conveying path of sheets P is appropriately changed based on modes that are implemented by the image decolorizing device 100. The image decolorizing device 100 has several processing modes. The image decolorizing device 100, for example, has (1) a first decolorization mode for implementing only a decolorization treatment without reading an image, (2) a second decolorization mode for implementing a decolorization treatment after reading an image, (3) a third decolorization mode for classifying (classification process) whether or not the sheets P are reusable, (4) a fourth decolorization mode for applying a decolorization treatment after reading an image and applying the classification process, (5) a read mode for applying a read process of an image without image decolorization, and the like. These respective modes can be selected from a control panel of the image decolorizing device 100 or an external terminal. In these decolorization modes, the sheets P are conveyed to the decolorization unit 103. On the other hand, in the read mode, the image decolorizing device 100 controls the first branch member 108 to discharge papers via the reading unit 102 without conveying the sheets P to the decolorization unit 103.

The image decolorizing device 100 has several sheet detection sensors 112 for detecting sheets that are conveyed through the first to third conveying paths 105, 106, and 107. The sheet detection sensors, for example, may be microsensors or microactuators. The sheet detection sensors are arranged at appropriate positions along the conveying paths 105, 106, and 107.

Next, the decolorization part of this embodiment will be explained in detail with reference to FIG. 2 to FIG. 10.

Figure 2:
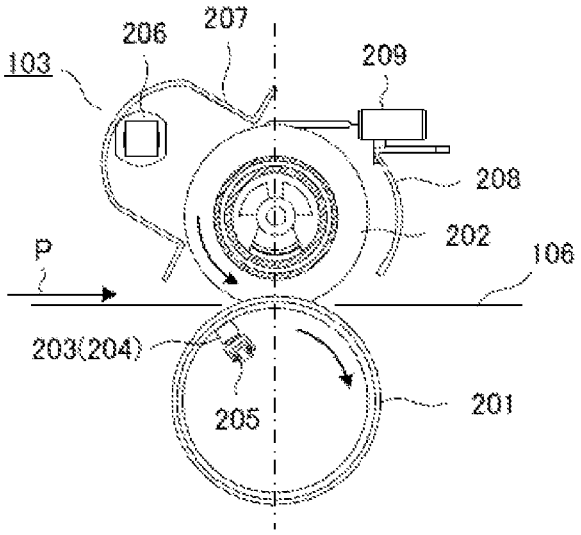
FIG. 2 is a schematic diagram showing a decolorization part in FIG. 1.
Figure 3:
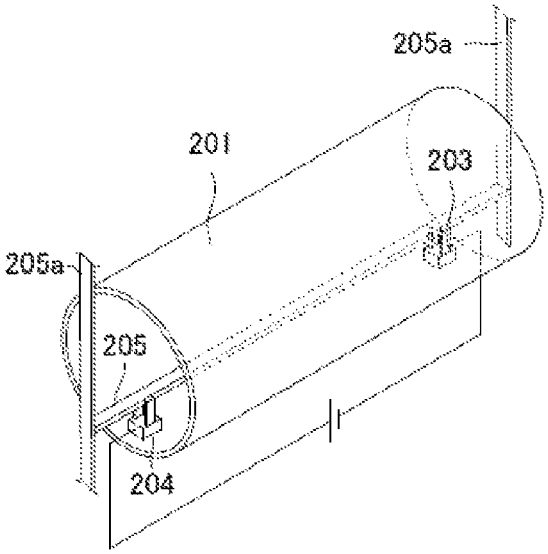
FIG. 3, FIG. 4, and FIG. 5 are outlined oblique views showing a cylindrical heating element.

As shown in FIG. 2 and FIG. 3, the decolorization unit 103 includes a cylindrical heating element 201 for heating the surface on which a toner image has been formed (hereinafter, also referred to "first surface") of the sheets P, a pressure roller 202 for forming a nip by pressure-contacting with the cylindrical heating element 201, a first contact part 203 in contact with the cylindrical heating element 201, and a second contact part 204. The cylindrical heating element 201 has a cylindrical shape. The cylindrical heating element 201 has a surface member with low surface resistance and high hardness, compared to the corresponding surface member of the pressure roller 202. The pressure roller 202 sandwiches and conveys the sheets P in cooperation with the cylindrical heating element 201.

The first contact part 203 and the second contact part 204 are arranged to be in contact with the inner surface of the cylindrical heating element 201. The first contact part 203 and the second contact part 204 are mounted on a shaft 205 that is inserted parallel with the axis of rotation (hereinafter, also referred to "horizontal scanning direction") of the cylindrical heating element 201. The shaft 205 is fixed by a shaft fixing part 205*a*. The first contact part 203 and the second contact part 204 are fixed in the rotating direction of the cylindrical heating element 201, whereas they can move along the shaft 205. In other words, the first contact part 203 and the second contact part 204 are securely arranged so that they can slide on the inner surface of the cylindrical heating element 201 in the axial direction of the cylindrical heating element 201.

Figure 4:
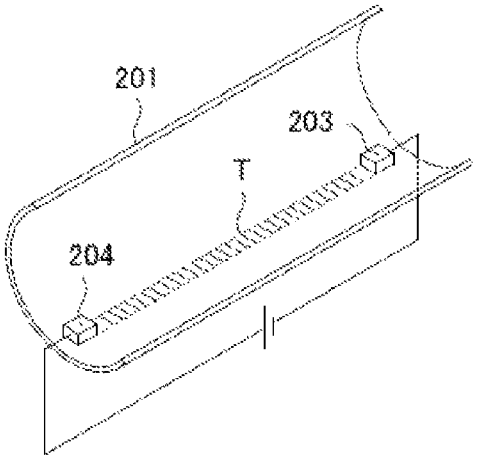
Figure 5:
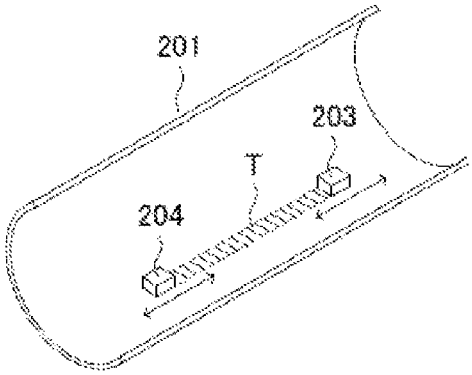

The first contact part 203 and the second contact part 204 are electrically connected to an external power source. The first contact part 203 and the second contact part 204 are electrified by applying a prescribed voltage. An area T of the second contact part 204 from the first contact part 203 of the cylindrical heating element 201 generates heat (FIG. 4). The first contact part 203 and the second contact part 204 slide are thus able to change the area T that generates heat. This can be seen in FIGS. 4 and 5. With this configuration, the heat can be generated only in a necessary and sufficient area for decolorizing images. In this embodiment, the sheets P are passed through the nip formed by the cylindrical heating element 201 and the pressure roller 202, to decolorize the images on the sheets P.

The temperature of the nip is required to be set to a color-erasable temperature. For this reason, the first contact part 203 and the second contact part 204 may move in a pattern in which they are sliding-contacted with the inner surface facing the nip of the cylindrical heating element 201, that is, a pattern in a straight line that connects the cylindrical heating element 201 and the rotational shaft of the pressure roller 202. On the other hand, since there is a slight time lag between heat generation to the decolorization temperature of the outer surface of the cylindrical heating element 201 after the electrification of the first contact part 203 and the second contact part 204, it is preferable to generate the heat at an upstream portion of the nip, specifically right in front of the nip with respect to the cylindrical heating element 201. With this in mind, the first contact part 203 and the second contact part 204 are preferably sliding-contacted with the cylindrical heating element 201 at a position upstream of the nip.

At the periphery of the pressure roller 202, a heating source 206 such as a halogen lamp for heating the pressure roller 202, a reflector 207 for applying heat from the heating source 206 with good efficiency to the pressure roller 202, and an insulating member 208 for insulating the pressure roller 202 are installed. In addition, the cylindrical heating element 201 and the pressure roller 202 are provided with temperature sensors 209 for measuring each surface temperature, and the information detected is output to the control unit 110. The control unit 110 controls a supply current based on the information input. Each surface temperature is controlled at an approximately equal temperature.

Figure 6:
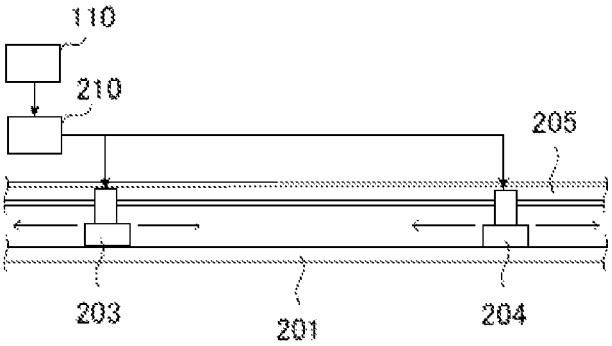
FIG. 6 is a cross section showing the cylindrical heating element.

As an example of the decolorizing operation of the decolorization unit 103, the reading unit 102 reads the image density of images of the sheets P. The control unit 110 detects that the image is printed in a unidirectional printing area of the sheet P read by the reading unit 102. Based on the detected printing area, the control unit 110 determines the decolorization width, that is, the heat generation area T, in accordance with the detected printing area. The first contact part 203 and the second contact part 204 are moved to positions corresponding to the area T via a driving mechanism such as motor by a contact driving part 210 existing in the control unit 110. The first contact part 203 and the second contact part 204 move along the shaft 205 and move to prescribed positions (FIG. 6). Next, a current is sent to the first contact part 203 and the second contact part 204. The current causes the first contact part 203 and the second contact part 204 to heat up. The sheet P is then conveyed between the heating element 201 and the pressure roller 202 to apply an image decolorization treatment, realizing partial erasure in the detected printing area. The reading unit 102 can also detect the sheet sizes such as A4, A3, and B5 of the sheets P, in addition to reading the image density.

OTHER EMBODIMENTS

Figure 7:
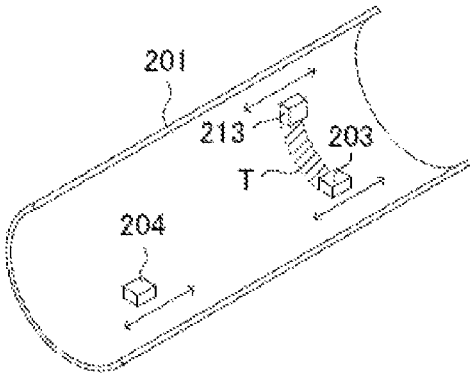
FIG. 7, FIG. 8, FIG. 9, and FIG. 10 show decolorization parts of other embodiments.

According to an alternative embodiment, shown in FIG. 7, a third contact part 213 is disposed in the rotating direction of the cylindrical heating element 201 with respect to the first contact part 203. The third contact part 213 can be moved in the horizontal scanning direction synchronously with the first contact part 203. With this configuration, a heat generation area T can also be generated in the rotating direction of the cylindrical heating element 201.

Figure 8:
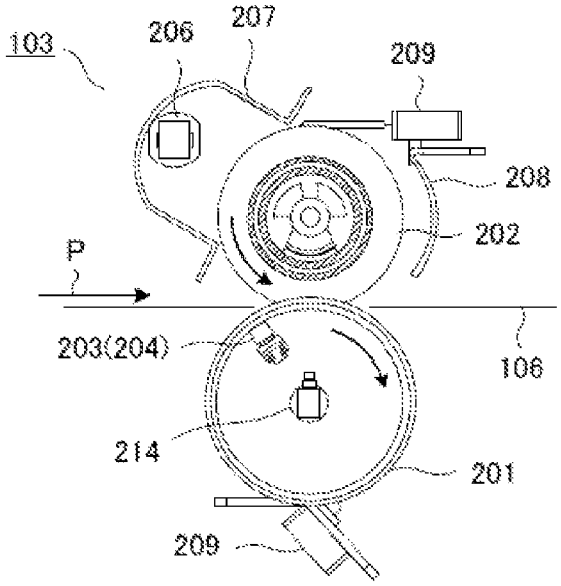

In addition, as shown in FIG. 8, a heating source 214 for preheating can be installed in the cylindrical heating element 201, thus being able to rapidly set to the heat generating area T of the first and second contact parts to a desired temperature.

Figure 9:
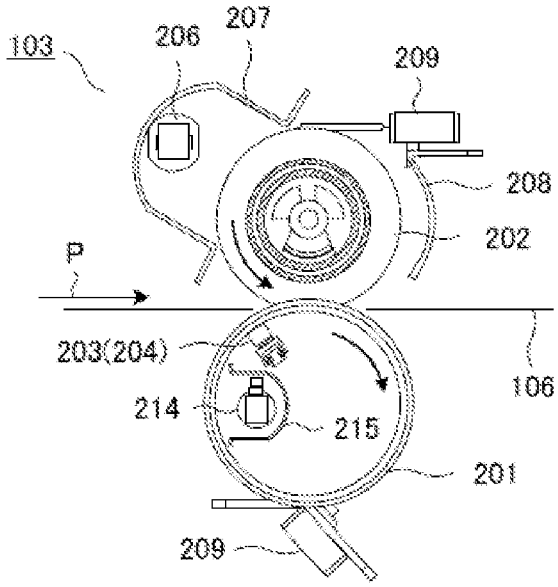

Moreover, as shown in FIG. 9, the heating source 214 can be installed at a position upstream from the first and second contacts 203 and 204 of the cylindrical heating element 201. A reflector 215 for applying heat from the heating source 214 with good efficiency to the upstream side is also installed, so that not only the heat generation area T of the first and second contact parts can be rapidly set to a desired temperature, but the power consumption can also be suppressed.

Here, a pattern in which the first contact part 203 and the second contact part 204 are arranged within the cylindrical heating element 201 is shown in the drawings. However, a pattern in which these contact parts are installed on the outside of the cylindrical heating element 201 and contact with the outer surface of the cylindrical heating element 201 may also be used.

(Double-Faced Image Decolorizing Device)

Figure 10:
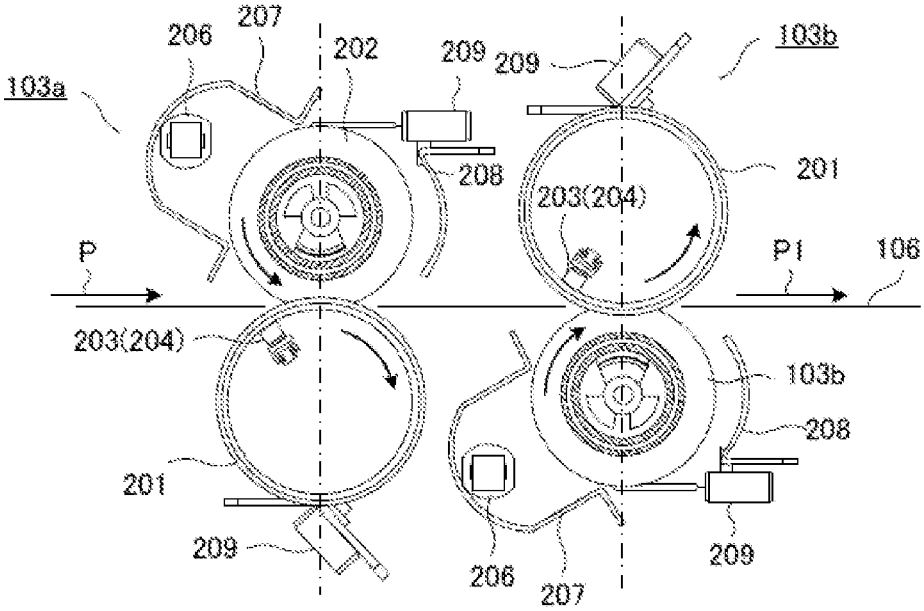

In case toner images formed on both surfaces of the sheet P are erased, as shown in FIG. 10, two decolorization units 103*a* and 103*b* are used to be able to decolorize both surfaces of the sheet P with good efficiency. The first surface of the sheet P is decolorized by the decolorization unit 103*a* at an upstream position with respect to the conveyance path 106 of the sheet P. The second surface, opposite the first surface of the sheet P, is decolorized by the decolorization unit 103*b* at a downstream position. Since the decolorizing surfaces of the sheet P are on opposite surfaces of the sheet P, the decolorization unit 103*b* at the downstream has a configuration in which the decolorization unit 103*a* at the upstream is reversed with respect to the positions of the cylindrical heating element 201 and the pressure roller 202.

Figure 11:
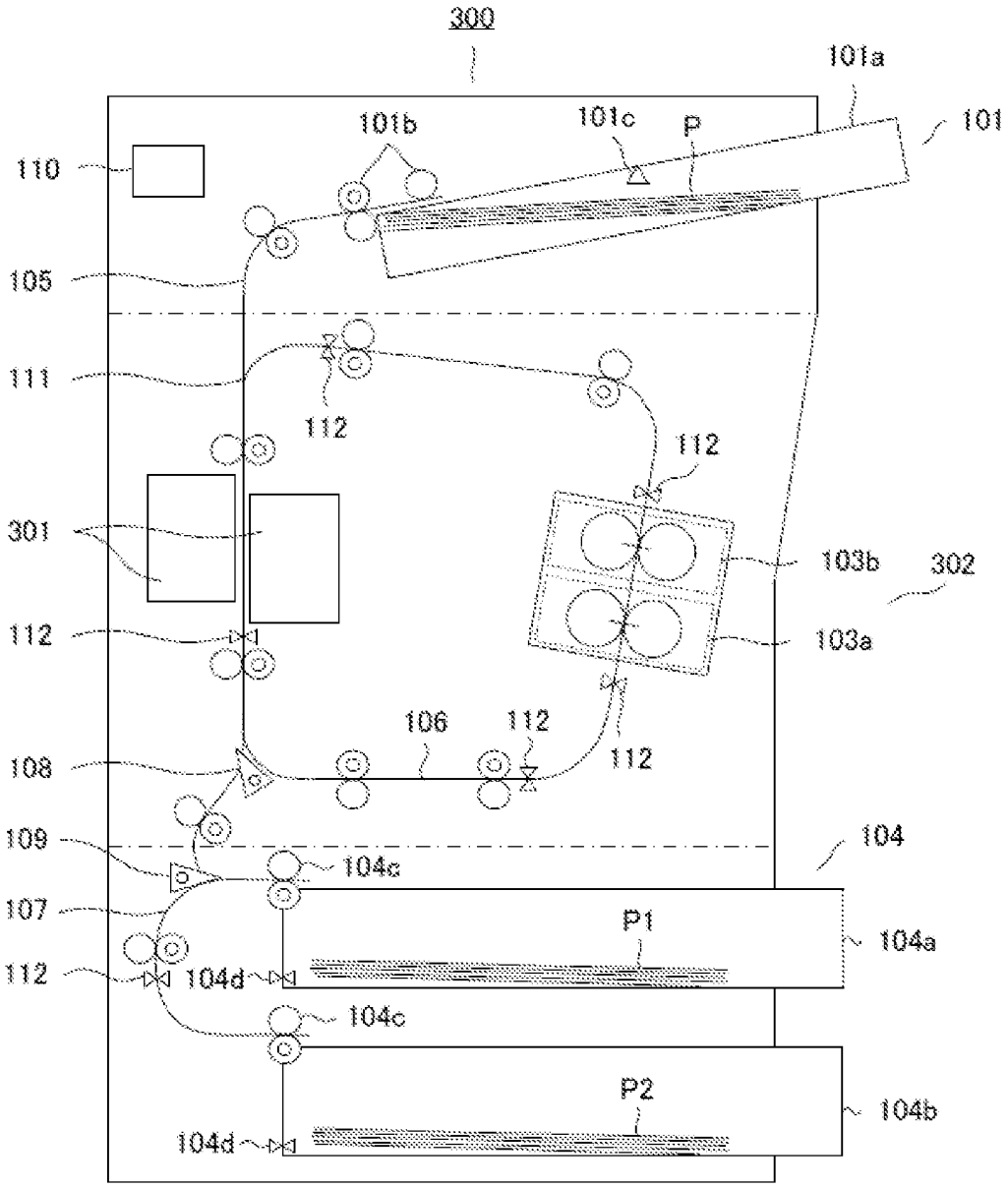
FIG. 11 is a schematic diagram showing the image decolorizing device to which the decolorization part in FIG. 10 is applied.

The image decolorizing device with the decolorization parts with this configuration is shown in FIG. 11. Here, in the following explanation, the same configuration as that of the image decolorizing device shown in FIG. 1 is omitted.

As shown in FIG. 11, in an image decolorizing device 300, a reading unit 301 is arranged along the first conveying path 105 downstream in the sheet conveying direction with respect to the paper feed tray 101*a*. The reading unit 301, for example, has reading units such as CCD (Charge Coupled Device) scanner or CMOS sensor. The reading unit 301 reads each image of the first surface and the second surface of the sheet P that is conveyed. In other words, the reading unit 301 includes two read units, which are arranged via the first conveying path 105, and can read both surfaces of the images of the sheet P that is conveyed.

A decolorization unit 302 is provided with decolorization units 103*a* and 103*b* of this embodiment. The decolorization units 103*a* and 103*b* of this embodiment are arranged along the second conveying path 106. The sheet P is sandwiched and conveyed by the decolorization unit 103*a* at an upstream position, decolorizing the first surface, and the sheet is sandwiched and conveyed by the decolorization unit 103*b* at a downstream position, decolorizing the second surface. In other words, the decolorization unit 302 decolorizes the images of both surfaces of the sheet P, which is conveyed, by a one-time conveyance.

In the above, according to the image decolorizing device of this embodiment, heat can be generated in only a necessary and sufficient area in accordance with area to be decolorized, thus being able to set a temperature required for decolorization in a short time at low power consumption, compared with the related arts.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image decolorizing device comprising:

a heating unit configured to generate heat and apply the heat to a recording medium;

a pressure roller that forms a nip with the heating unit and configured to pass the recording medium through the nip in cooperation with the heating unit;

a first contact part positioned in contact with the heating unit at a first position upstream of the nip in a rotation direction of the heating unit and fixed in the rotating direction; and a second contact part positioned in contact with the heating unit at a second position upstream of the nip in the rotation direction and fixed in the rotating direction, wherein when a voltage is applied to the first and second contact parts, the heating unit generates heat over a heating area between the first and second positions, and at least one of the first contact part and the second contact part is movable relative to the heating unit toward a longitudinal end of the heating unit.

2. The image decolorizing device according to claim 1, wherein the first and second contact parts are arranged relative to each other in a straight line parallel to the axis of rotation of the heating unit.

3. The image decolorizing device according to claim 2, wherein the first contact part is movable along the straight line.

4. The image decolorizing device according to claim 3, wherein the second contact part is movable along the straight line.

5. The image decolorizing device according to claim 1, wherein the first contact part and the second contact part are positioned in contact with an inner surface of the heating unit.

6. The image decolorizing device according to claim 5, further comprising:

a reading unit; and a contact driving unit, wherein the reading unit is configured to detect a printed area of an image on the recording medium, and the contact driving unit is configured to move the first contact part and the second contact part based on the detected printed area.

7. The image decolorizing device according to claim 6, wherein:

the reading unit is configured to detect a size of the recording medium, and the contact driving unit is configured to move the first contact part and the second contact part based on the detected size of the recording medium.

8. The image decolorizing device according to claim 3, further comprising:

a third contact part, wherein the third contact part is positioned upstream in the rotating direction of the heating unit with respect to the first contact part, and is movable along the straight line synchronously with the first contact part, and when a voltage is applied to the third contact, the heating unit generates heat over an area between the first and third positions.

9. The image decolorizing device according to claim 1, further comprising:

a heating source provided in the heating unit and configured to heat at least a portion of the heating unit upstream of the first and second positions.

10. A method for decolorizing an image comprising:

conveying recording medium to a nip between a heating unit and a pressure roller;

applying a voltage to a first contact part that is in contact with the heating unit at a first position upstream of the nip in a rotation direction of the heating unit and fixed in the rotating direction and a second contact part that is in contact with the heating unit at a second position upstream of the nip in the rotation direction and fixed in the rotating direction, to cause the heating unit to generate heat over a heating area between the first and second positions, wherein at least one of the first contact part and the second contact part is movable relative to the heating unit toward a longitudinal end of the heating unit; and heating the recording medium with the heating unit to decolorize an image formed on the recording medium.

11. The method for decolorizing an image according to claim 10, wherein the first position and the second position are arranged relative to each other in a straight line parallel to the axis of rotation of the heating unit.

12. The method for decolorizing an image according to claim 11, wherein the first contact part is movable along the straight line.

13. The method for decolorizing an image according to claim 12, wherein the second contact part is movable along the straight line.

14. The method for decolorizing an image according to claim 10, wherein the first contact part and the second contact part are positioned in contact with an inner surface of the heating unit.

15. The method for decolorizing an image according to claim 14, further comprising:

reading an image on the recording medium; and detecting a printed area in the image on the recording medium, wherein the first contact part and the second contact part are positioned based on the detected printed area.

16. The method for decolorizing an image according to claim 15, further comprising:

detecting a size of the recording medium, wherein the first contact part and the second contact part are positioned based on part based on the detected size of the recording medium.

17. The method for decolorizing an image according to claim 12, further comprising:

applying a voltage to a third contact part that is upstream in the rotating direction of the heating unit with respect to the first contact part, to cause the heating unit to generate heat over an area between the first and third positions, wherein the third contact part is movable along the straight line synchronously with the first contact part.

18. The method for decolorizing an image according to claim 10, further comprising:

heating at least a portion of the heating unit upstream of the first and second contact parts with a heating source.

19. An image decolorizing apparatus comprising:

a heating unit configured to generate heat and apply the heat to a recording medium;

a pressure roller that forms a nip with the heating unit and configured to pass the recording medium through the nip in cooperation with the heating unit; a first contact part positioned in contact with the heating unit at a first position upstream of the nip in a rotation direction of the heating unit and fixed in the rotating direction; and a second contact part positioned in contact with the heating unit at a second position upstream in the rotating direction of the heating unit with respect to the first contact part, wherein the first and second contact parts are movable synchronously along a straight line parallel to an axis of rotation of the heating unit, and when a voltage is applied to the first and second contact parts, the heating unit generates heat over a heating area between the first and second positions.

20. The image decolorizing device according to claim 19, further comprising:

a third contact part, wherein the third contact part is positioned in contact with the heating unit at a third position upstream of the nip in the rotation direction and fixed in the rotating direction, the first contact part and the third contact part are positioned in a straight line parallel to an axis of rotation of the heating unit, and when a voltage is applied to the third contact part, the heating unit generates heat over an area between the first and third positions.

* * * * *